US006755596B2

(12) United States Patent
Schibi

(10) Patent No.: US 6,755,596 B2
(45) Date of Patent: Jun. 29, 2004

(54) PLASTIC LINED CANAL

(76) Inventor: Charles W. Schibi, 4706 Grand Lake, Corpus Christi, TX (US) 78413

( * ) Notice: Subject to any disclaimer, the term of this patent is extended or adjusted under 35 U.S.C. 154(b) by 0 days.

(21) Appl. No.: 09/764,172

(22) Filed: Jan. 16, 2001

(65) Prior Publication Data

US 2002/0094238 A1 Jul. 18, 2002

(51) Int. Cl.[7] ..... E02B 5/02
(52) U.S. Cl. ..... 405/270
(58) Field of Search ..... 405/270, 268, 405/129.75, 38, 118, 119

(56) References Cited

U.S. PATENT DOCUMENTS

| | | | | | |
|---|---|---|---|---|---|
| 1,363,690 | A | * | 12/1920 | Sullivan | 405/270 |
| 2,308,294 | A | * | 1/1943 | McCorkle et al. | 405/270 |
| 3,854,292 | A | * | 12/1974 | Nienstadt | 405/270 |
| 4,741,645 | A | | 5/1988 | Butler | |
| 4,787,776 | A | * | 11/1988 | Brady et al. | 405/270 |
| 4,828,432 | A | * | 5/1989 | Ives | 450/270 |
| 5,160,221 | A | * | 11/1992 | Rohe et al. | 405/268 |
| 5,213,438 | A | | 5/1993 | Barenwald | |
| 5,568,995 | A | | 10/1996 | Beamer | |
| 5,573,351 | A | | 11/1996 | Beamer | |
| 5,613,804 | A | | 3/1997 | Beamer | |
| 5,735,638 | A | | 4/1998 | Beamer | |
| 5,806,252 | A | * | 9/1998 | Scuero | 405/268 |
| 5,882,145 | A | | 3/1999 | Beamer | |

FOREIGN PATENT DOCUMENTS

| | | | | |
|---|---|---|---|---|
| JP | 57-29718 | * | 2/1982 | 405/270 |
| JP | 62-29610 | * | 2/1987 | 405/270 |
| JP | 3-51411 | * | 3/1991 | 405/270 |
| JP | 4-7499 | * | 1/1992 | 405/270 |

OTHER PUBLICATIONS

Publication of Duro–Last, Inc.—properlt ès of Roofing Material & Technique of Fastening "The World's Rest Roof", (undated).

* cited by examiner

*Primary Examiner*—Frederick L. Lagman
(74) *Attorney, Agent, or Firm*—G. Turner Moller

(57) ABSTRACT

An irrigation canal includes a plastic liner mechanically connected to the canal by fasteners extending through tabs located between the liner and the canal so the fasteners do not extend through the membrane providing leak protection. Adjacent the side walls of the canal, the tabs have a free end above the fixed end so that the tab is easily accessible during installation. The plastic is reinforced with a fiber mesh and has a tear strength above 100 pounds force. In the case of a concrete lined canal, a pilot hole is drilled in the concrete and a fastener is driven through the tab into the pilot hole. In the case of an earthen canal, anchors are embedded in the earth along the length of the canal and longitudinally extending members are connected between the anchors. The plastic liner is mechanically connected to the longitudinally extending members.

24 Claims, 3 Drawing Sheets

FIG. 1
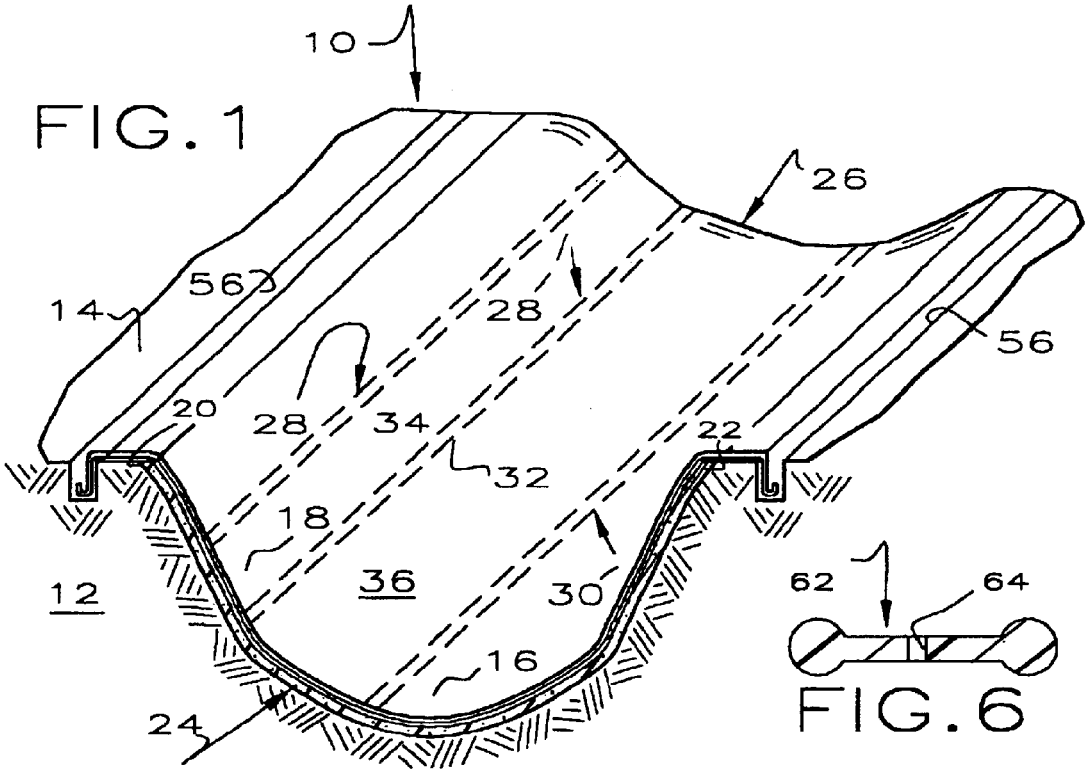
FIG. 6
FIG. 3
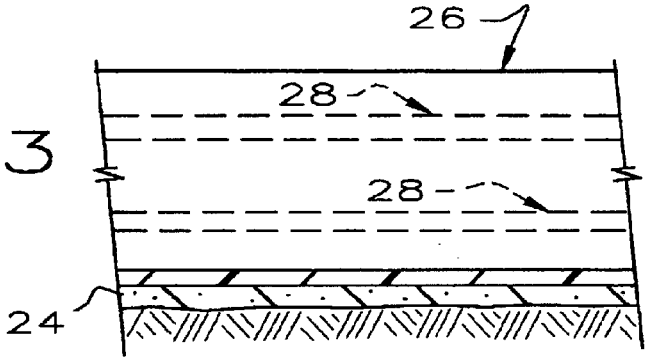
FIG. 5
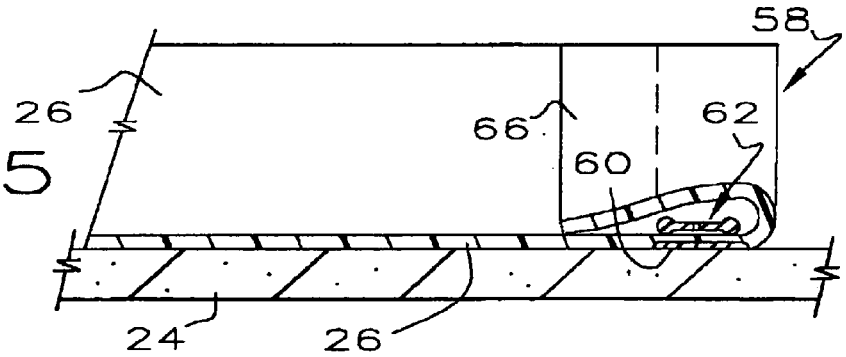

PLASTIC LINED CANAL

This invention relates to a plastic lined canal and more particularly to a canal having a plastic liner therein for the purpose of reducing leakage from the canal.

BACKGROUND OF THE INVENTION

Canals, ditches, or trenches, which are here used synonymously, are widely used to transport liquids by gravity flow. There are thousands of miles of irrigation canals of various sizes in agricultural areas of the world, used to transport water to fields. Many have earthen bottoms and sides and many are lined with concrete or similar materials. Some are dug into the earth and some are dug in berms or dikes elevated above the surrounding countryside. Universally, they leak, either because they are earthen or because of cracks or other imperfections in the lining.

A wide variety of techniques have been used to lessen or control leakage from irrigation ditches and canals with more or less success. Some techniques simply dump clay or swellable materials such as bentonite into the canal on the theory that the clay particles will migrate to the source of the leak and seal off the leakage. Other techniques involve applying plastic liners to the canals, none of which have heretofore been both successful and cost effective. All techniques are costly to greater or lesser extent.

Disclosures relevant to the disclosure of this invention are found in U.S. Pat. Nos. 4,741,645; 5,213,438; 5,568,995; 5,573,351; 5,613,804; 5,735,638 and 5,882,145.

SUMMARY OF THE INVENTION

In this invention, a plastic liner is mechanically fastened to the canal in such a way that the fastener does not pass through the membrane providing leak protection. This is accomplished by providing a tab or flap on the side of the membrane adjacent the canal and passing the fastener through the tab or flap. The membrane is typically wide enough to pass up and drape over the edge of the canal. The exposed edge is terminated in a suitable permanent manner.

The membrane is preferably of a plastic material reinforced by strong fibers, preferably in a mesh. The membrane is preferably sufficiently strong that, even after being cut with an instrument, the cut cannot be enlarged by pulling on the material adjacent the cut. Preferably, the tear strength of the material is above 100 pounds of force. A preferred material is commercially available and has a tear strength of 130×110 pounds of force.

Preferably, one or more tabs or flaps on the membrane extend along the length of the trench, one near the bottom of the trench and one or more on each side. The membrane is unrolled in any suitable manner to place the tab parallel to and in the canal. In the case of a concrete lined canal, a pilot hole is drilled in the concrete and a fluted concrete nail or concrete screw is placed through a washer or suitable load spreading device, through the tab and driven into the pilot hole. In the case of an earthen canal, anchors are driven into the earth along the length of the canal and members extending down the canal are connected to the anchors. A fastener is driven through the tab and into the members.

In this manner, a durable plastic liner is mechanically connected to the canal thereby substantially reducing leakage in a cost effective manner without passing a fastener through the leak reducing membrane.

It is an object of this invention to provide an improved plastic liner for a canal.

A further object of this invention is to provide a plastic liner mechanically connected to a canal in such a manner that the fasteners do not penetrate the leak protective membrane.

These and other objects and advantages of this invention will become more apparent as this description proceeds, reference being made to the accompanying drawings and appended claims.

BRIEF DESCRIPTION OF THE DRAWINGS

FIG. 1 is a cross-sectional/isometric view of a canal provided with a liner of this invention;

FIG. 3 is a longitudinal cross-sectional view of the plastic liner and canal, as viewed from the center of the canal;

FIG. 5 is an enlarged cross-sectional view of an end of the plastic liner;

FIG. 6 is an enlarged cross-sectional view of a bar used in terminating an end or edge of the plastic liner;

DETAILED DESCRIPTION

Figure 2:
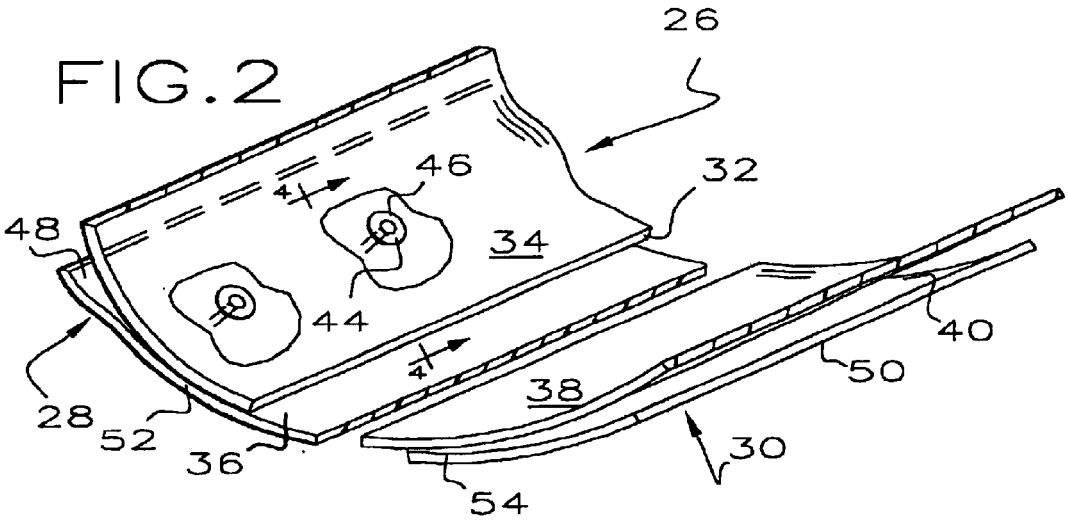
FIG. 2 is an enlarged view of the plastic liner, illustrating the leak protective membrane and the fastening tabs.

Referring to FIGS. 1–6, a canal 10 has been excavated from the earth 12 below ground level 14 to provide a gravity flow, open top channel having a bottom 16, side walls 18 and a pair of generally identical parallel edge or top structures 20, 22. A conventional concrete liner 24 has been installed originally providing a more-or-less impermeable barrier to water or liquid loss. Those skilled in the art will recognize the canal 10 as representative of irrigation canals common in many agricultural areas of the world.

Because many of such canals 10 have been in use for long periods, the concrete lining 24 has been cracked, usually by soil movement due to expansion and contraction of the underlying earth 12 due to wetting and drying of the soil. In some situations, very large percentages of water delivered to the canal system are lost before it reaches its destination. Because only a small percentage of the lost water is due to evaporation, the vast bulk of shrinkage is from seepage through the concrete liner 24. This is not surprising because close inspection of concrete lined canals reveals that large cracks are common in some areas. If large water losses are common in concrete lined canals, it is easy to understand that even larger losses are sustained in earthen or unlined canals. There are a number of techniques to repair cracked concrete lined canals, none of which have heretofore had the desirable combination of low cost and being effective.

In this invention, an impermeable plastic liner 26 is mechanically attached to the canal 10 thereby preventing the liner 26 from moving relative to the canal 10 and eliminating or drastically reducing leaking of water from the canal.

Because the fasteners do not extend through the water protective membrane, the canal is made impermeable for the length of the plastic liner 26.

To this end, the liner 26 includes a series of attachment tabs or flaps 28, 30 between the liner 26 and the concrete lining 24. As shown in FIG. 2, the tabs 28, 30 are of two different types. The plastic liner 26 is typically made of several long sections bonded together in seams 32. Where it is desirable to provide an attachment tab adjacent a seam 32, a section 34 of the liner 26 is attached to a section 36 away from the end of the section 36 to leave the tab 28. Where it is desirable to provide an attachment tab intermediate the edges of a liner section 38, a piece of material 40 is attached to the section 38 thereby providing the tab 30.

Figure 4:
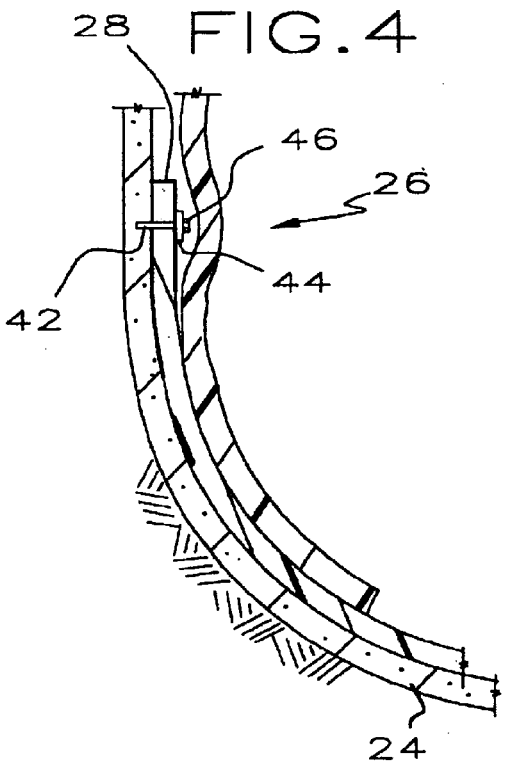
FIG. 4 is an enlarged cross-sectional view of the plastic liner of FIG. 2, taken substantially along line 4—4 thereof, as viewed in the direction indicated by the arrows.

As shown best in FIGS. 2–4, a pilot hole 42 is drilled at least part way through the concrete liner 24, the tab 28 is pulled upwardly to overlie the pilot hole 42, a washer 44 is placed over the pilot hole 42 and a fastener 46 is driven into the pilot hole 42. The fastener 46 may be of any suitable type, such as a fluted concrete nail, a concrete screw, a concrete anchor or the like. The fasteners 46 are driven through the tabs 28, 30 along the length of the tabs at suitable intervals, e.g. 6–24" apart. It will be seen that the fasteners 46 provide a head between the liner 26 and the tabs 28, 30 and do not penetrate the impermeable liner 26.

Preferably, the plastic liner 26 is attached in a first path along the bottom 16 of the canal 10, e.g. along a centerline of the concrete lining 24 and on one or more paths on the sides 18. FIG. 1 shows a center attachment path and two attachment paths on each side of the concrete liner 24.

An important but subtle feature of this invention is shown in FIG. 2 where the tabs 28, 30 away from the centerline have their free ends 48, 50 above the fixed ends 52, 54. There are two reasons for this arrangement, the most important of which has to do with the manner in which the plastic liner 26 is rolled out in the bottom of the canal 26 and unfolded during installation as will be more fully apparent hereinafter. In addition, the tabs on the sides 18 of the canal 10 are in tension and the tabs manifestly hang better with the free ends 48, 50 above the fixed ends 52, 54.

The plastic liner 26 is preferably made of an unusual material. The preferred material is a fiber reinforced polyvinyl chloride copolymer commercially available from Duro-Last, Inc. of Saginaw, Mich. The fiber reinforcement is an 18×14 pattern, weft inserted polyester scrim. The polyvinyl chloride copolymer is weldable by the application and heat and pressure in a conventional manner, using a hot air gun to provide the heat and a roller to provide the pressure. It will accordingly be seen that the seam 32 and the tab 30 are provided by welding sections of like material together. The preferred material has a minimum tear strength of 100 pounds force, meaning that at least 100 pounds of force are necessary to tear the material, and preferably has a tear strength of 130×110 pounds force, meaning that the material is stronger in one direction than in a direction perpendicular thereto. This is sufficient that cuts made in the material with an instrument are not enlarged by manually pulling on the material adjacent to the cut.

The liner 26 is installed in any suitable manner. The liner 26 is commercially available from manufacturers such as Duro-Last, Inc., of Saginaw, Mich. Preferably, in the process of manufacture, the liner 26 is made of any desirable width, and is wide enough to drape over the upper edges 20, 22 of the concrete liner 24. In the process of manufacture, the liner 26 is folded to be of a width substantially less than the width of the canal 10 and having a central fastening tab 30 laid out along one edge of the rolled material. The folded liner 26 is rolled up at the manufacturer's plant and transported to the job site. The length of the liner 26 in any one roll is selected to be suitable to the effort required to handle the roll and is of a convenient length, e.g. 50'. A modest crew can easily handle fifty foot lengths.

At the job site, the rolled liner 26 is placed in the canal 10 and unrolled so the central fastening tab 30 extends along or generally parallel to a centerline of the canal. Fasteners 46 are driven through the tab 30 thereby securing a central portion of the liner 26 in the canal. The uppermost folded section of the liner 26 is then unfolded and moved toward the side of the canal 10. Fasteners 46 are driven through the next adjacent fastening tab 28 along the length of the liner 26. This process of unfolding a section of the unrolled liner and securing it to the canal is repeated until the outside edges of the liner 26 are passed over the top edges 20, 22 of the canal and placed in narrow trenches 56 parallel to and adjacent the top edges 20, 22. The trenches 56 are filled with concrete thereby making a suitable permanent termination of the liner edges.

When the next adjacent liner section is to be attached to an existing liner, the liner sections are cleaned, overlapped and welded together in a conventional manner. Because the material of the liner 26 is preferably thermoplastic, this is accomplished by use of a conventional hot air gun providing heat and a roller providing pressure, similar to the seams made by the manufacturer. The process of laying liner sections end to end is repeated until the desired length of the canal 10 is lined with the liner 26. These end-to-end joints made in the field are called field made joints.

When it is desired to terminate the liner 26 in the canal 10 or make an accommodation for a branch of the canal leading off at an angle to the main canal, a termination 58 is made as shown in FIGS. 5–6. A caulk strip 60 is placed under the liner 26 a short distance from the end. A termination bar 62 is laid on top of the liner 26 immediately above the caulk strip 60. The caulk strip 60 and termination bar 62 are sufficiently long to extend above the water line on each side of the canal 10 up to at least the upper edges 20, 22. Suitable fasteners, such as fluted nails or concrete screws, are driven through openings 64 in the termination bar 62 compressing the caulk strip 60 and securing the end of the liner 26 to the canal 10. The free end 66 of the liner 26 is reversed over the top of the termination bar 62 and sealed to the liner 26 in any suitable manner, as by the application of heat and pressure.

It will accordingly be seen that the liner 26 of the invention provides an effective impermeable barrier against leakage of water or other liquid from the concrete lined canal 10.

Figure 8:
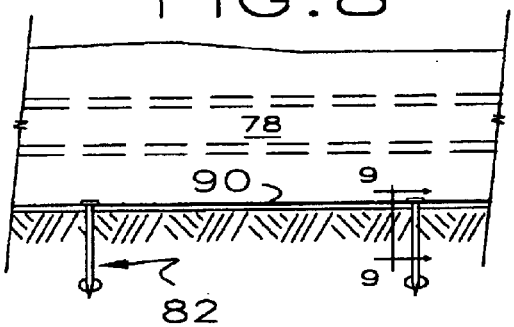
FIG. 8 is a longitudinal cross-sectional view of the earthen canal of FIG. 7, as viewed from the center of the canal illustrating a framework to which a plastic liner is attached.
Figure 7:
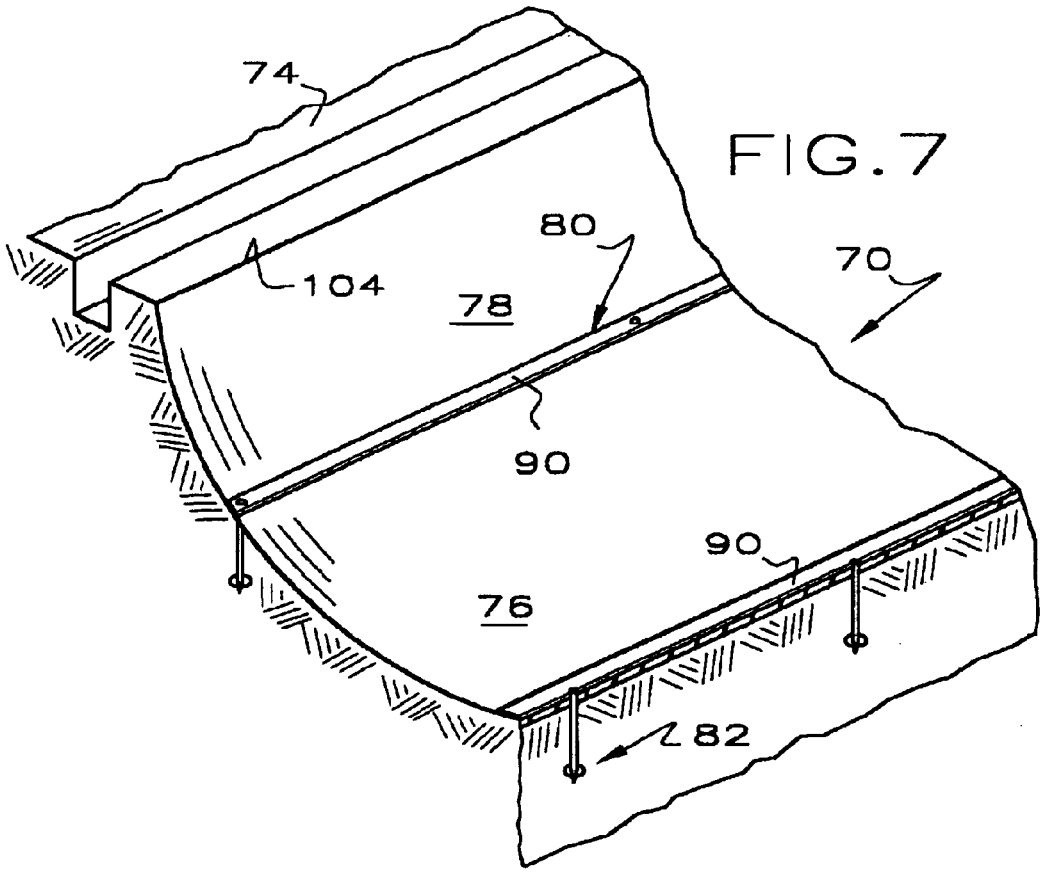
FIG. 7 is an isometric view of a fastening system for securing a plastic liner to an earthen canal which has been broken away down the centerline of the canal to expose anchors in the earth.
Figure 9:
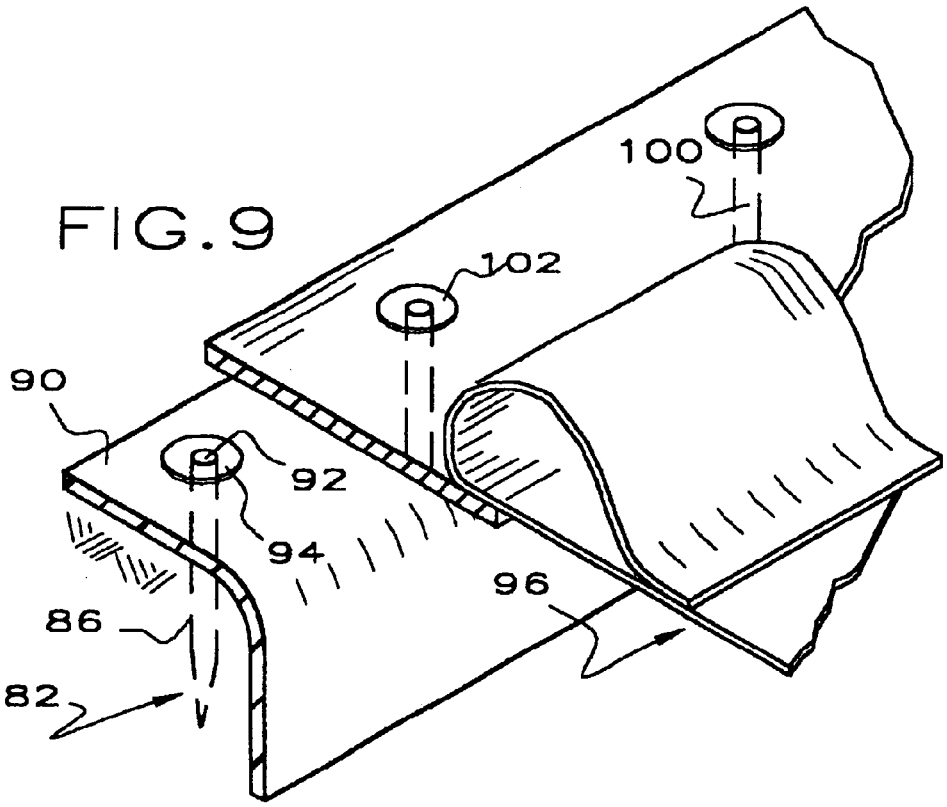
FIG. 9 is an enlarged broken isometric cross-sectional view of the earthen canal of FIGS. 7–8.

Referring to FIGS. 7–9, there is illustrated an earthen canal 70 excavated from the earth 72 below ground level 74 to provide a gravity flow, open top channel having a bottom 76 and side walls 78. To secure a plastic liner in the canal 70, a suitable framework 80 is provided to which the liner is secured. To this end, a series of anchors 82 are driven into the earth in paths extending parallel to the length of the canal 70. As will be more fully apparent hereinafter, the paths of the anchors 82 correspond to the position of the fastening tabs or flaps of the plastic liner.

The anchors 82 may be of any suitable type and are illustrated as auger or screw type anchors similar to those used in anchoring mobile homes to the earth. Thus, the anchors 82 have a shaft 86 providing a helical flange 88 adjacent the bottom. The anchors are driven into the earth with a suitable powered device so the upper end of the shaft 84 is at, or slightly below, ground level.

A series of longitudinally extending members 90 are attached to the anchors 82 in any suitable manner, as by the provision of a fastener 92 and washer 94. The members 90 are preferably corrosion resistant and have sufficient mechanical strength to receive mechanical fasteners and stabilize the plastic liner. To this end, the members 90 are preferably aluminum alloys, plastic or the like and may comprise structural shapes such as angles, boxes or I-beams.

After the framework 80 is installed, a rolled up plastic liner 96 is laid in the canal 70 and unrolled, in the same manner that the plastic liner 26 is unrolled in the concrete lined canal 10 so a longitudinally extending tab or flap 98 extends parallel to the length of the canal 70 adjacent to the member 90 which lies along the canal centerline. The tab 98 is connected to the member 90 by drilling a series of pilot holes in the member 90, placing the tab 98 over the pilot hole and driving a nail or screw 100 through a washer 102 into the pilot hole. After the center of the plastic liner is secured to the central member 90, the plastic liner 96 is unfolded and then secured to the next adjacent member 90. In a sense, the framework 80 and the members 90 act as a mechanical support for the plastic liner 96 in much the same manner that the concrete liner 24 acts as a support for the liner 26. The sides of the plastic liner 96 extends over the top of the canal 70 and into a pair of trenches 104 in the same manner as the liner 26.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. An open top gravity flow liquid transport canal having a length providing a direction of flow and edges providing a width and having therein a plastic liner comprising a series of sections secured together at field made joints extending transverse to the length of the canal, at least a plurality of the sections comprising a continuous impermeable unpunctured membrane extending beyond the edges of the canal and across the canal width and extending from an upstream end toward a downstream end along a length of the canal for minimizing leakage from the canal and at least one tab between the liner and the canal and a series of fasteners extending through the tab having a head between the tab and the liner, the plurality of sections being free of field made joints extending along the length of the canal.

2. The canal of claim 1 wherein the canal includes a concrete liner.

3. The canal of claim 2 wherein a hole is drilled into the concrete liner and the fastener is driven into the hole.

4. The canal of claim 3 wherein the fastener is a fluted nail.

5. The canal of claim 3 wherein the fastener is a concrete screw.

6. The canal of claim 1 wherein the canal has a bottom and first and second side walls and a first tab extends along the length of the canal adjacent the bottom, a second tab extends along the length of the canal adjacent the first side wall and a third tab extends along the length of the canal adjacent a second side wall and wherein the fasteners extend through each tab at spaced intervals along the length of the canal.

7. The canal of claim 6 wherein the tabs have a first end connected to the plastic liner and a second free end, the second free ends of the second and third tabs being above the first ends.

8. The canal of claim 1 wherein the plastic liner has a tear strength above 100 pounds force.

9. The canal of claim 8 wherein the plastic liner has a fiber mesh embedded therein.

10. The canal of claim 9 wherein the plastic liner is of a thermoplastic material sealable by heat and pressure.

11. The canal of claim 10 wherein the tab is of the same material as the liner.

12. The canal of claim 1 wherein the canal is earthen.

13. The canal of claim 12 wherein the anchoring means includes an anchor extending into the earth and means connecting the fastener to the anchor.

14. The canal of claim 1 wherein the canal is excavated from the earth.

15. The canal of claim 1 wherein the canal is in a dike elevated above the surrounding area.

16. The canal of claim 1 wherein the liner has sides extending in the same direction as the canal and there are at least three tabs extending along the length of the liner, at least one of the tabs being spaced from the sides of the liner before the installation of a fastener.

17. The method of lining an open top gravity flow liquid transport canal having a length providing a direction of flow, comprising providing a plurality of one-piece plastic liner sections having ends spaced along the length of the canal and sides providing a width wider than the canal and at least one tab on a first side of the liner intermediate the sides and ends of the liner, the sections being free of field made joints extending along the length of the canal; then placing the liner sections in the canal so the first and second ends are spaced apart along the length of the canal and then placing the tab adjacent the canal;

then anchoring the liner to the canal including driving at least one fastener through the tab; and then placing the sides of the liner over a top of the sides of the canal.

18. The method of claim 17 wherein the canal is concrete lined and the anchoring step comprises drilling a pilot hole into the concrete and then driving the fastener into the pilot hole.

19. The method of claim 17 wherein the plastic liner is rolled up in a width less than the width of the canal and the placing step comprises unrolling the plastic liner in the canal and attaching a first tab to the bottom of the canal; and then unfolding a section of the plastic liner and placing the section on a side of the canal and attaching a second tab to the side of the canal.

20. The method of claim 19 wherein the unrolling step including placing the first tab on a centerline of the canal bottom.

21. An open top gravity flow liquid transport earthen canal having therein an impermeable plastic liner providing at least one tab between the liner and the canal and a series of anchors extending into the earth in a path along a length of the canal, a member connected between adjacent anchors and a series of fasteners extending through the tab and the member at spaced intervals along the length of the canal and having a head between the tab and the liner.

22. An open top gravity flow liquid transport canal having a length providing a direction of flow and having therein an impermeable plastic liner and at least three spaced apart tabs between the liner and the canal and a series of fasteners extending through the tabs having a head between the tab and the liner for anchoring the liner to the canal, at least part of one of the tabs being in an area where the liner is continuous before a fastener is inserted through the tab, the plastic liner comprising a series of sections, at least a plurality of the sections being free of field made joints extending along the length of the canal.

23. The open top gravity flow liquid transport canal of claim 22 wherein the tabs extend along the length of the canal, the sections having ends spaced along the length of the canal and sides transverse to the length, the tab where the liner is continuous before a fastener is inserted through the tab being adjacent the center of the liner.

24. An open top gravity flow liquid transport canal having a length providing a direction of flow and having therein an impermeable plastic liner providing first and second ends spaced apart along the length of the canal and first and second sides transverse to the first and second ends and at least three tabs between the liner and the canal extending in the direction of flow, and several series of fasteners extending from adjacent the first liner end to adjacent the second liner end and projecting through the tab having a head between the tab and the liner for anchoring the liner to the canal, at least one of the tabs being spaced from the sides of the liner before the installation of a fastener, the plastic liner comprising a series of sections, at least a plurality of the sections being free of field made joints extending along the length of the canal.

* * * * *